US005944463A

United States Patent [19]

Savage, Jr.

[11] Patent Number: 5,944,463

[45] Date of Patent: Aug. 31, 1999

[54] CLAMP CONNECTION OF ELECTRICAL WIRING AND ELECTRICAL LEAD STRUCTURE

[76] Inventor: John M. Savage, Jr., 538-B Via De La Valle, Solana Beach, Calif. 92075

[21] Appl. No.: 08/900,030

[22] Filed: Jul. 22, 1997

[51] Int. Cl.[6] ..... H01R 4/24

[52] U.S. Cl. ..... 409/419; 439/419

[58] Field of Search ..... 439/404, 405, 439/409, 419, 658, 620; 362/241, 419, 251, 249, 252, 227, 226, 800, 806

[56] References Cited

U.S. PATENT DOCUMENTS 4,252,396 2/1981 Wilson ..... 439/405

5,330,368 7/1994 Tsuruzono ..... 439/409

5,494,455 2/1996 Shindoh et al. ..... 439/402

*Primary Examiner*—Steven L. Stephan

*Assistant Examiner*—Barry M. L. Standig

*Attorney, Agent, or Firm*—William W. Haefliger

[57] ABSTRACT

In apparatus for clamp-up electrical connection of electrical wiring and electrical lead structure, the combination comprises first and second relatively movable clamping elements and defines therebetween a first zone to receive the electrical wiring and a second zone to receive the electrical lead structure; electrical terminal structure extending between the zones; and clamping elements relatively movable toward one another to effect clamping of the wiring rotating toward the terminal structure at the first zone, and clamping of the lead structure relatively toward the terminal structure.

26 Claims, 10 Drawing Sheets

21
20
122
123
11b
11a
11
35b
34b
31b
33b
35a
34a
31a
33a
50
51
28
70
52
32b
38
42
40
32a
42
29
25

CLAMP CONNECTION OF ELECTRICAL WIRING AND ELECTRICAL LEAD STRUCTURE

BACKGROUND OF THE INVENTION

This invention relates generally to clamp connection of electrical components, and more particularly to clamp connection of electrical wiring and electrical lead structures where the wiring and lead structures are spaced apart.

There is need in certain instances to connect electrical lead structure, as for example light source leads, to electrical wiring, at selected position or positions along the length of such wiring. As an example, the wiring may extend along a pathway to be illuminated, and it is required that light sources be connected to the wiring at selected positions along its length for illuminating the pathway or adjacent areas at the selected positions. In particular, there is need for light source units of improved reliable, rugged construction that can be easily clamp attached to elongated electrical current carrying wiring, at various selected positions along the wiring length, and in such a way that electrical connection is reliably made to light source leads spaced from the wiring within the unit or units.

SUMMARY OF THE INVENTION

It is a major object of the invention to provide improved apparatus, and method of use of such apparatus, incorporating the above needs. Such apparatus provides for clamp-up electrical connection of electrical wiring and light electrical lead structure (as for example light source), and comprises:

a) first and second relatively movable clamping elements and defining therebetween a first zone to receive the electrical wiring and a second zone to receive the electrical lead structure, b) electrical terminal structure extending between said zones, c) the clamping elements relatively movable toward one another to effect clamping of the wiring relatively toward the terminal structure at the first zone, and clamping of the lead structure relatively toward the terminal structure.

Another object is to provide such connection where the electrical terminal structure extends crosswise of the first and second zones which are spaced apart. In this regard, the clamping elements typically have hinge interconnection to define a hinge axis, and the wiring and lead structure may both extend generally parallel to the hinge axis to facilitate their simultaneous connection to the terminal structure as during clamp-up of the clamping elements. Such terminal structure typically extends generally normal to the in-place wiring, the in-place lead structure, and the hinge axis.

A further object is to provide such terminal structure, a local portion of which includes blade means to penetrate sheathing defined by said electrical wiring, in response to relative movement of said clamping elements toward one another. Electrical contact with the current carrying core of the wiring is thereby achieved, during clamp-up.

Yet another object is to provide terminal structure that includes shoulder means to be forcibly engaged by at least one lead defined by said lead structure, in response to relative movement of said clamping elements toward one another.

An additional object is to provide at least one electrical impedance element, such as a resistor, located to be clamped into electrical series connection with the lead structure in response to relative movement of the clamping elements toward one another.

The terminal structure may advantageously include a plate carried by one of the clamping elements, and having an edge facing the other clamping element the impedance element, such as a resistor, positioned to engage that edge to be clamped against the edge in response to clamp-up of the apparatus. The resistor is in electrical series with the light source to determine its degree of illumination; and the construction of the apparatus allows ready selection and placement of different resistors, of selected resistance, in operating position. Typical light sources are LEDs, and light bulbs incorporating energizable filaments.

These and other objects and advantages of the invention, as well as the details of an illustrative embodiment, will be more fully understood from the following specification and drawings, in which:

DRAWING DESCRIPTION

DETAILED DESCRIPTION

Figure 1:
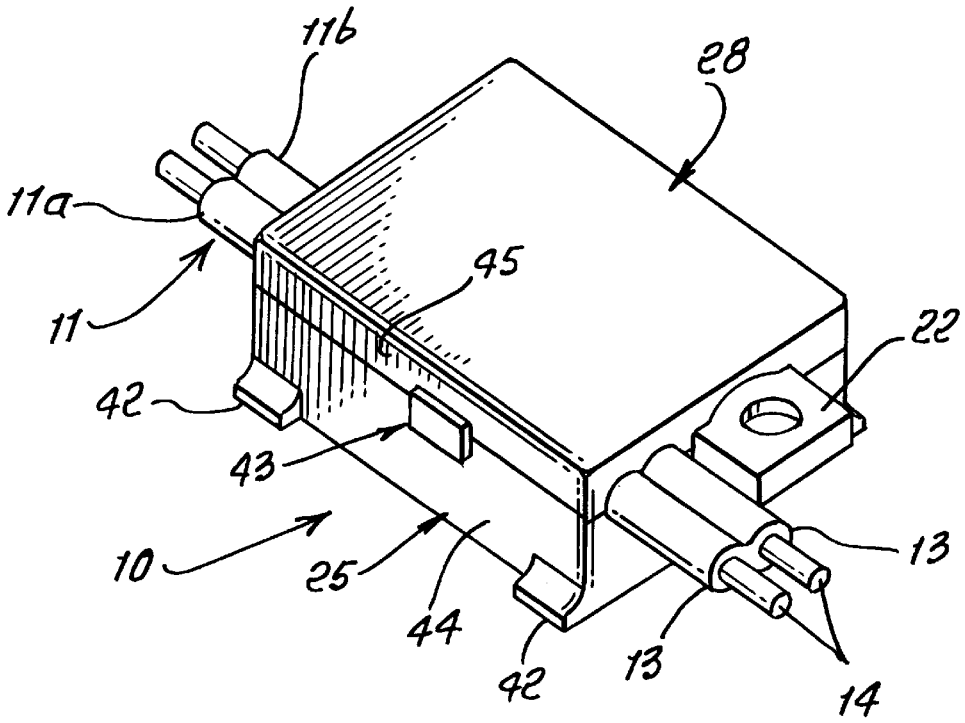
FIG. 1 is a perspective external view of clamp-up apparatus, incorporating the invention, and showing use with an LED.
Figure 2:
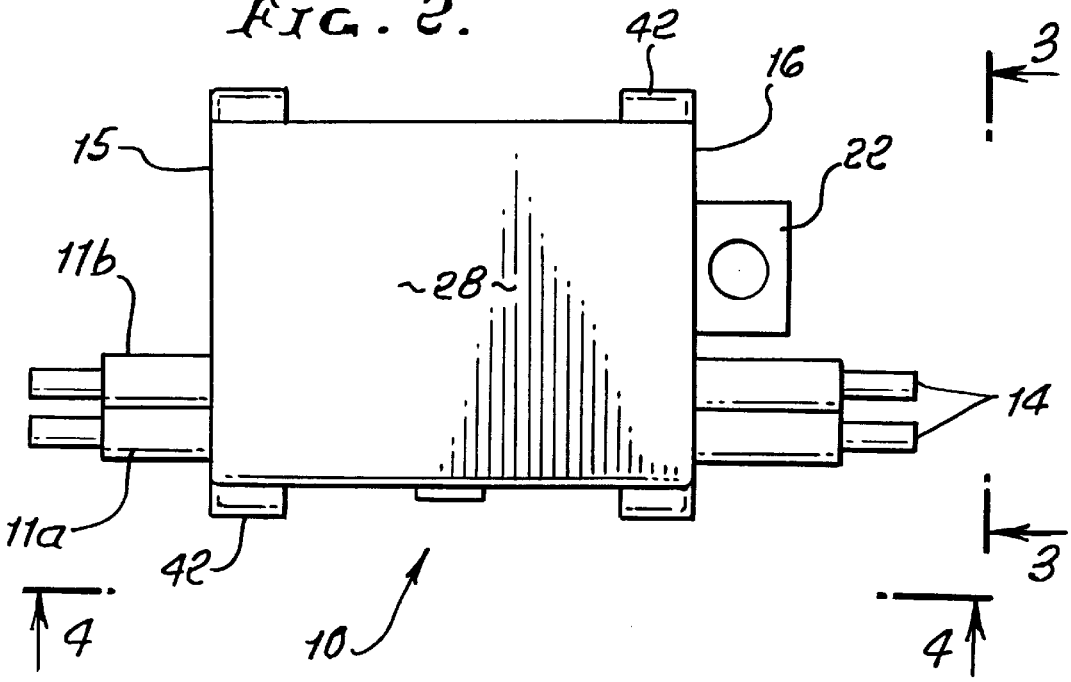
FIG. 2 is a top plan view of the FIG. 1 apparatus.
Figure 3:
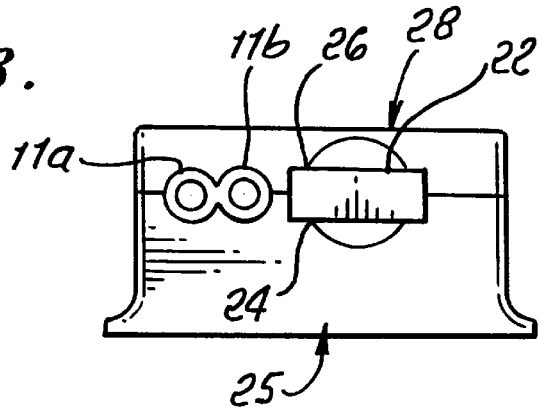
FIG. 3 is an end elevation view taken on lines 3—3 of FIG. 2.
Figure 4:
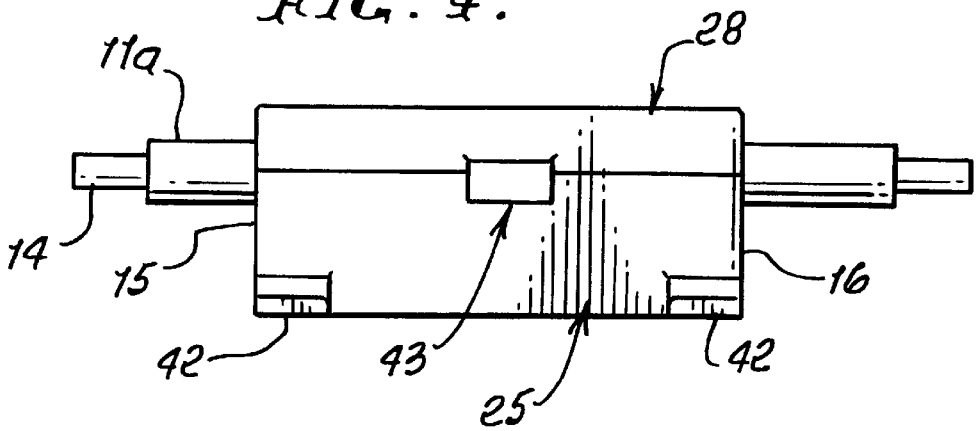
FIG. 4 is a side elevation view taken on lines 4—4 of FIG. 2.
Figure 5:
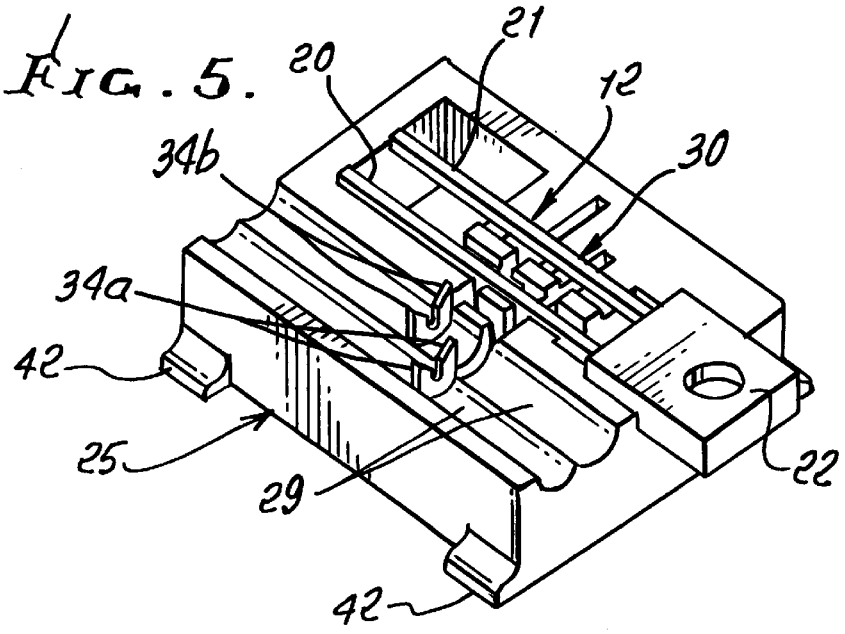
FIG. 5 is a perspective view of the lower clamping element of the FIG. 1 apparatus.

Referring first to FIGS. 1–8, preferred apparatus is shown at 10 for clamp-up electrical connection of electrical wiring, as at 11, and electrical lead structure, as at 12. Wiring 11 may typically include two electrical power carrying wires 11*a* and 11*b*, each including insulative sheathing 13 and a metallic, current carrying core 14. The wiring 11 is shown in FIGS. 1 and 4 as extending within apparatus 10, and from opposite ends 15 and 16 of that apparatus, and it will be understood that the apparatus may be connected to the wiring at any location along its length, or along a pathway to be illuminated, for example.

Lead structure 12 may typically include two spaced, parallel, metallic leads 20 and 21 and an LED holder 22 in the form of a block, from which the leads 20 and 21 project within the apparatus 10. The holder 22 may support a light source such as LED indicated at 23 in FIG. 8. The holder may be partially received, and thereby supported, within a recess 24 in a lower clamping body element 25 of the apparatus 10, and also partially received within a recess 26 in an upper clamping body element 28 of the apparatus 10, as is clear from FIG. 3, whereby the holder leads 20 and 21 are positioned, as shown. The projecting portion of the holder carries the LED, and the leads 20 and 21 are initially held in position by the positioned holder block 22 to extend lengthwise longitudinally in parallel, or substantially parallel relation to the two wires 12. The leads are laterally spaced from the wires, as shown. Note in FIGS. 5 and 6 that prior to downward closure of the upper clamping element 28 toward lower clamping element 25, leads 20 and 21 extend parallel to the elongated first zone or zones 29 such as channels which are downwardly recessed into the lower body element 25 so as to closely conform to and support the wires 12 upon completed clamp-up. The wires are sidewardly received into such channels. Leads 20 and 21 extend within a second elongated zone 30 of the lower clamping element, spaced laterally from first zone or zones 29.

In accordance with an important aspect of the invention, electrical terminal structure is provided to extend between the described first and second zones 29 and 30. The terminal structure is located so that when the clamping elements 25 and 28 are relatively closed toward one another, they effect clamping of the wiring relatively toward the terminal structure at the first zone, and clamping of the lead structures relatively toward the terminal structure at the second zone. Typically, the electrical terminal structures includes at least one, and preferably two thin, parallel, metallic plates 31, such as plates 31*a* and 31*b*, that extend crosswise of and preferably normal to the wiring and leads at the two zones 29 and 30, as referred to. The construction is such that the terminal structure preferably bridges the two zones.

The two plates 31*a* and 31*b* are shown as received downwardly in laterally extending slots 32*a* and 32*b* formed in lower body element 25. Sidewardly struck or deflected tangs 33*a* and 33*b* formed on or by the terminal plates project from the planes of the two plates to engage the slot wall sidewardly for retaining the plates in the slots. See FIG. 9.

Figure 9:
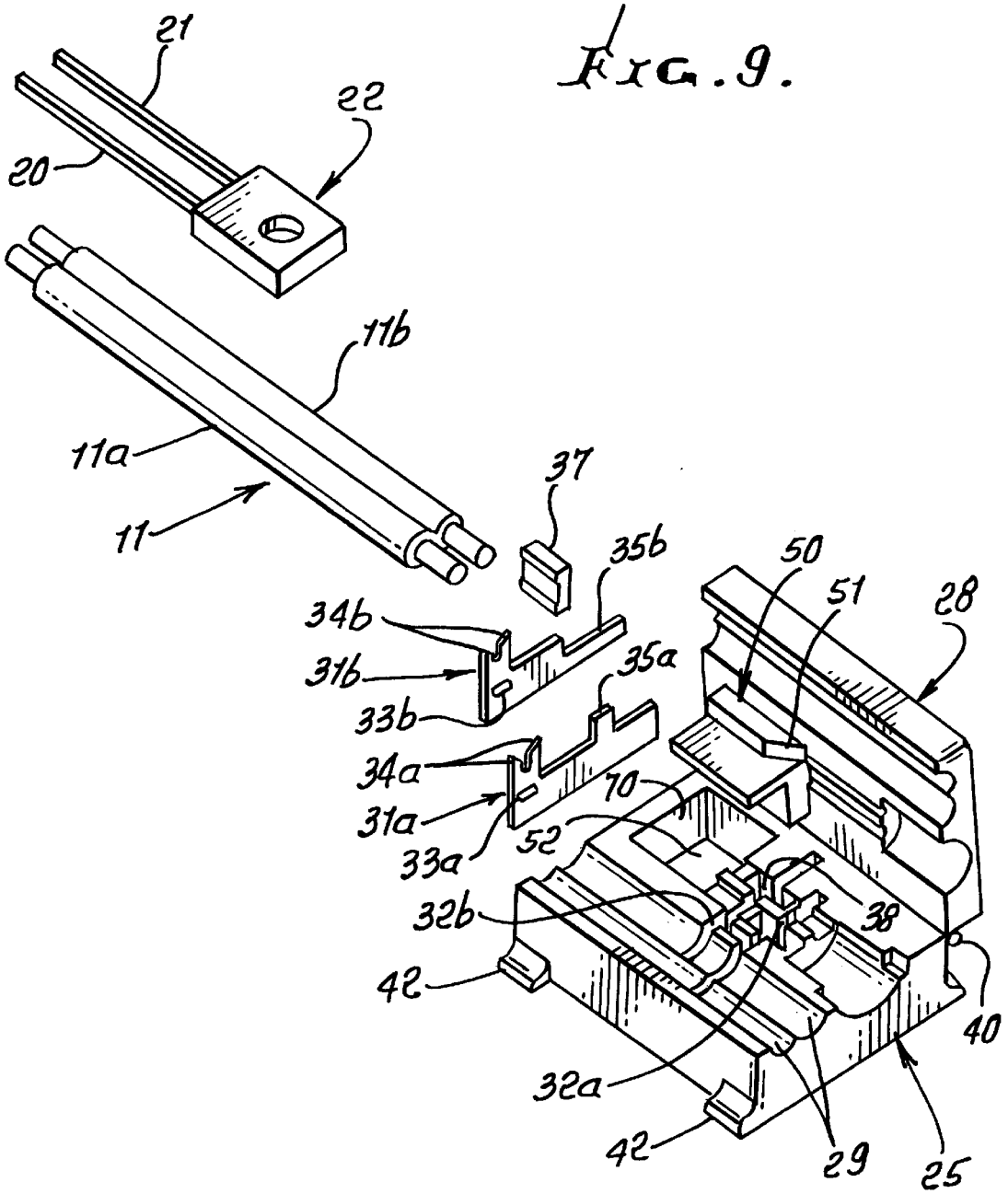
FIG. 9 is an exploded perspective view of the FIG. 1 apparatus in open condition and also showing wiring and lead components.
Figure 10:
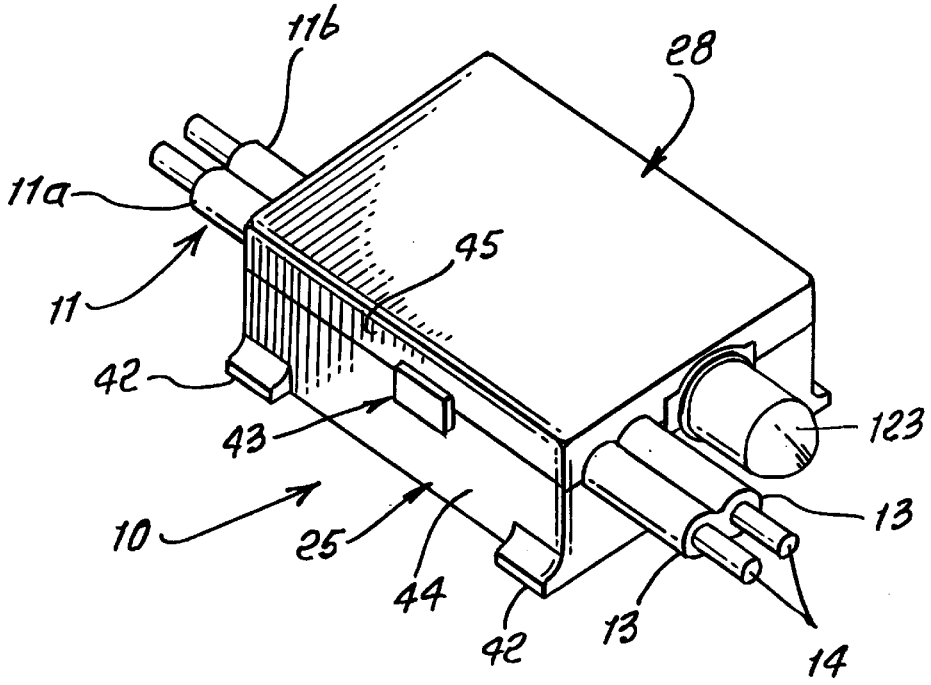
FIG. 10 is a view of apparatus like that of FIG. 1, showing use with a light bulb.
Figure 11:
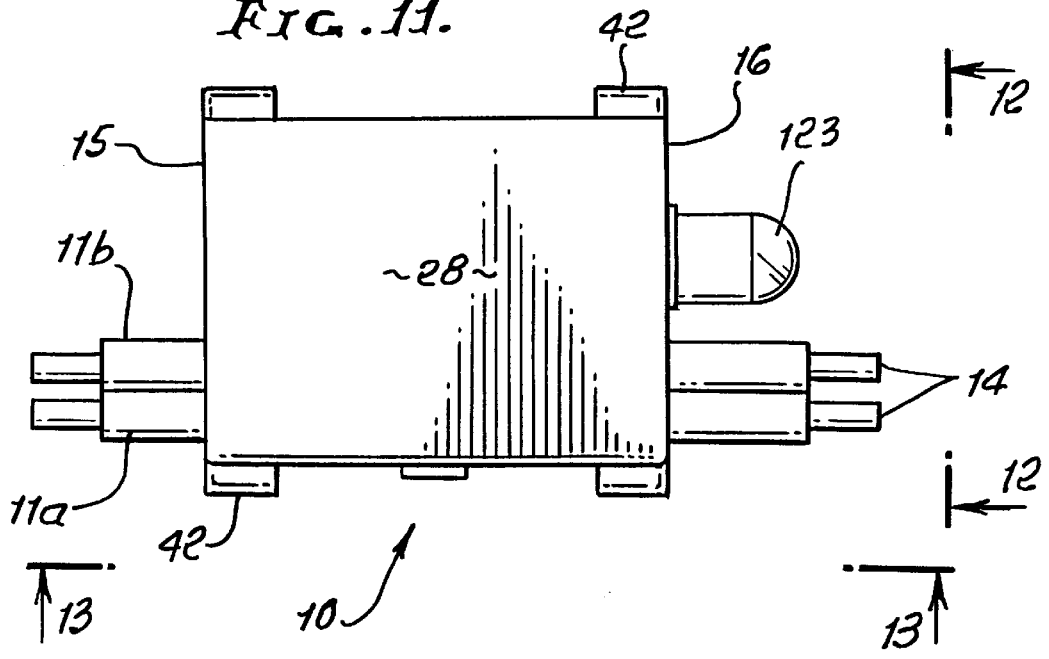
FIG. 11 is a top plan view of the FIG. 10 apparatus.
Figure 12:
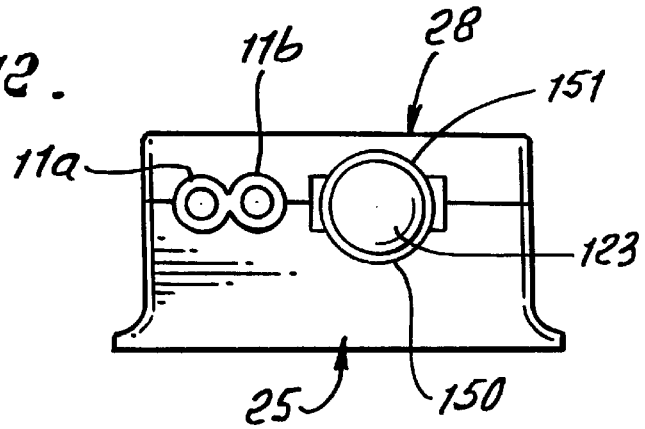
FIG. 12 is an end elevation view taken on lines 12—12 of FIG. 11.
Figure 13:
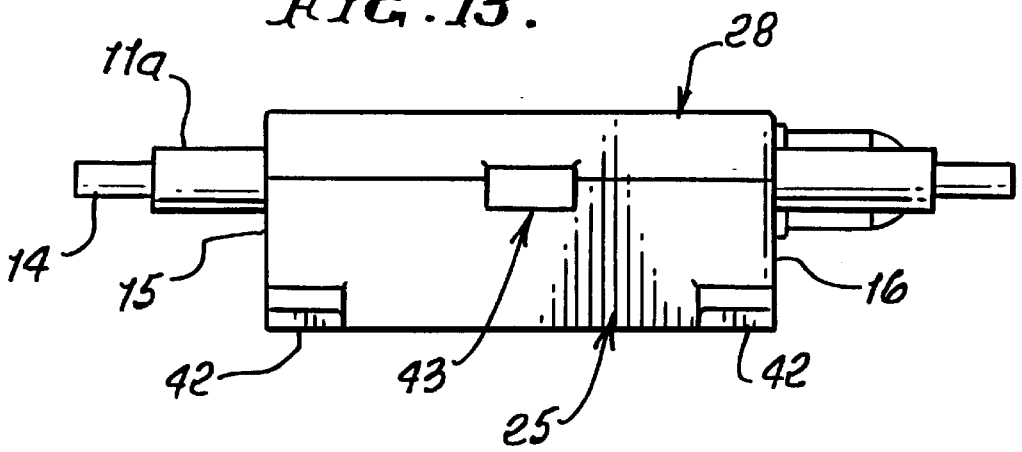
FIG. 13 is a side elevation view taken on lines 13—13 of FIG. 11.
Figure 14:
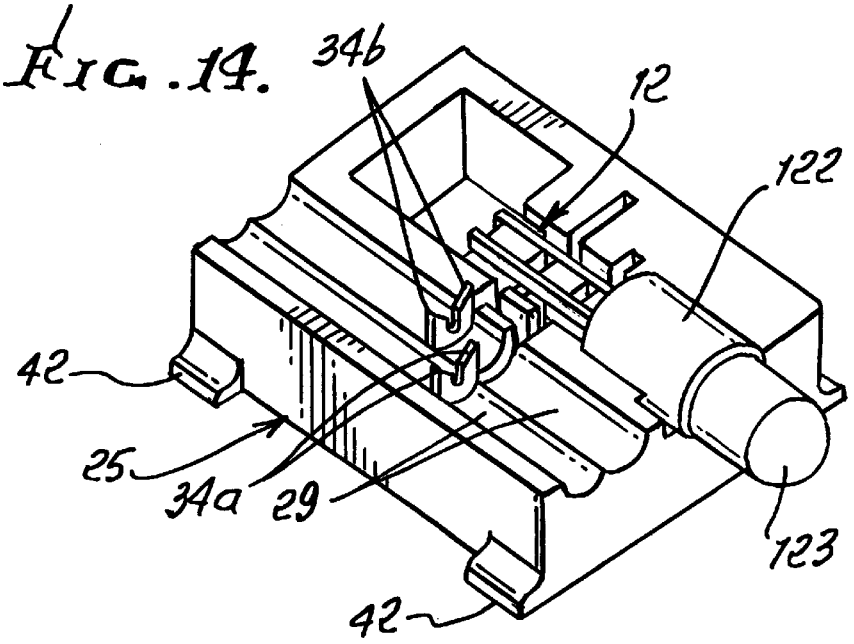
FIG. 14 is a perspective view of the lower clamping element of the FIG. 10 apparatus.
Figure 15:
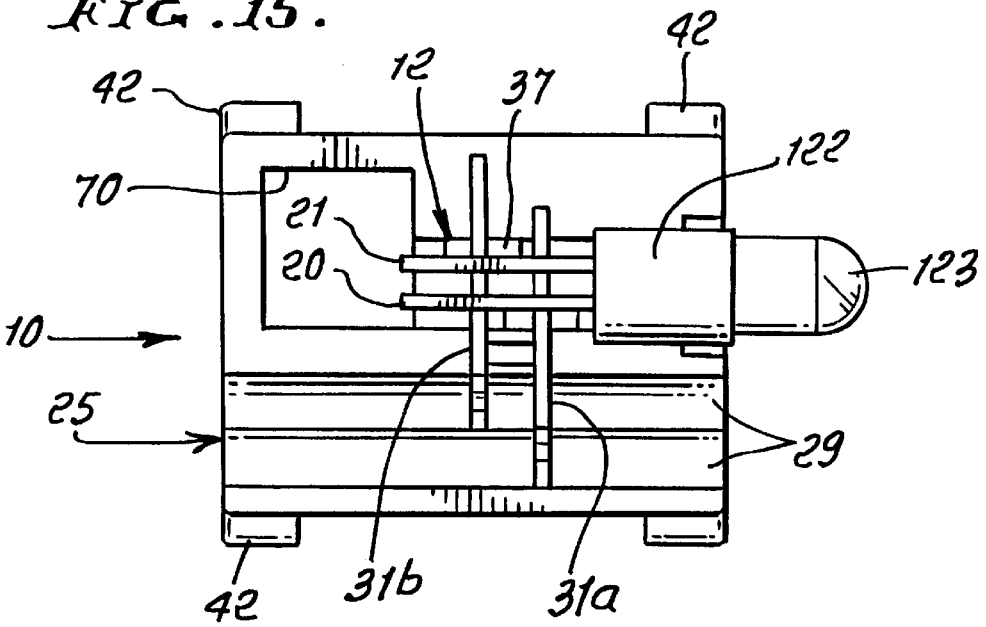
FIG. 15 is a top plan view of the FIG. 14 element.
Figure 16:
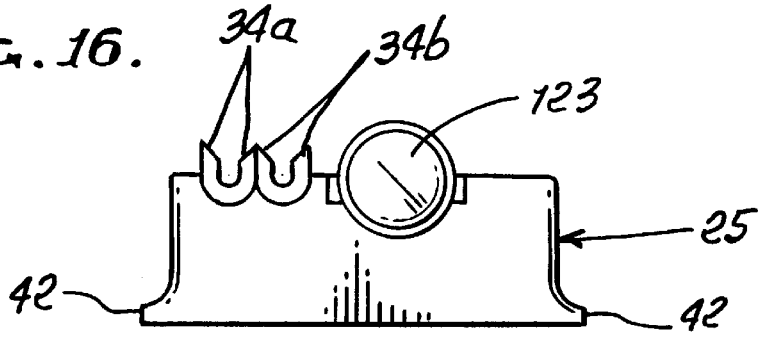
FIG. 16 is an end elevation view of the FIG. 15 element.
Figure 17:
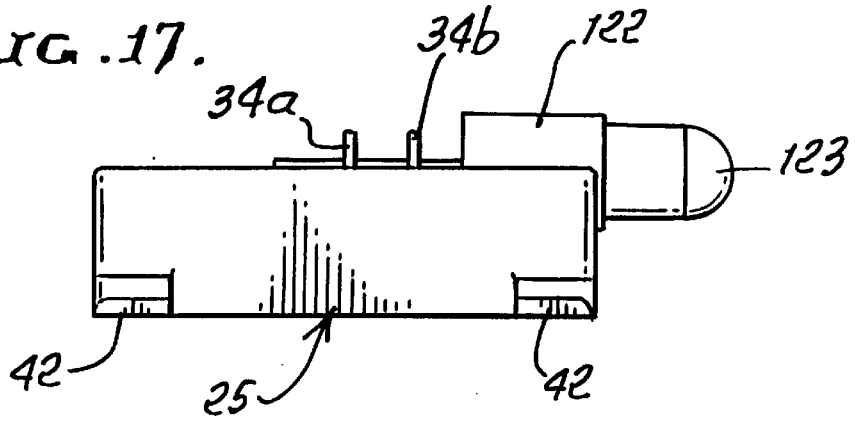
FIG. 17 is a die elevation view of the FIG. 15 element.
Figure 18:
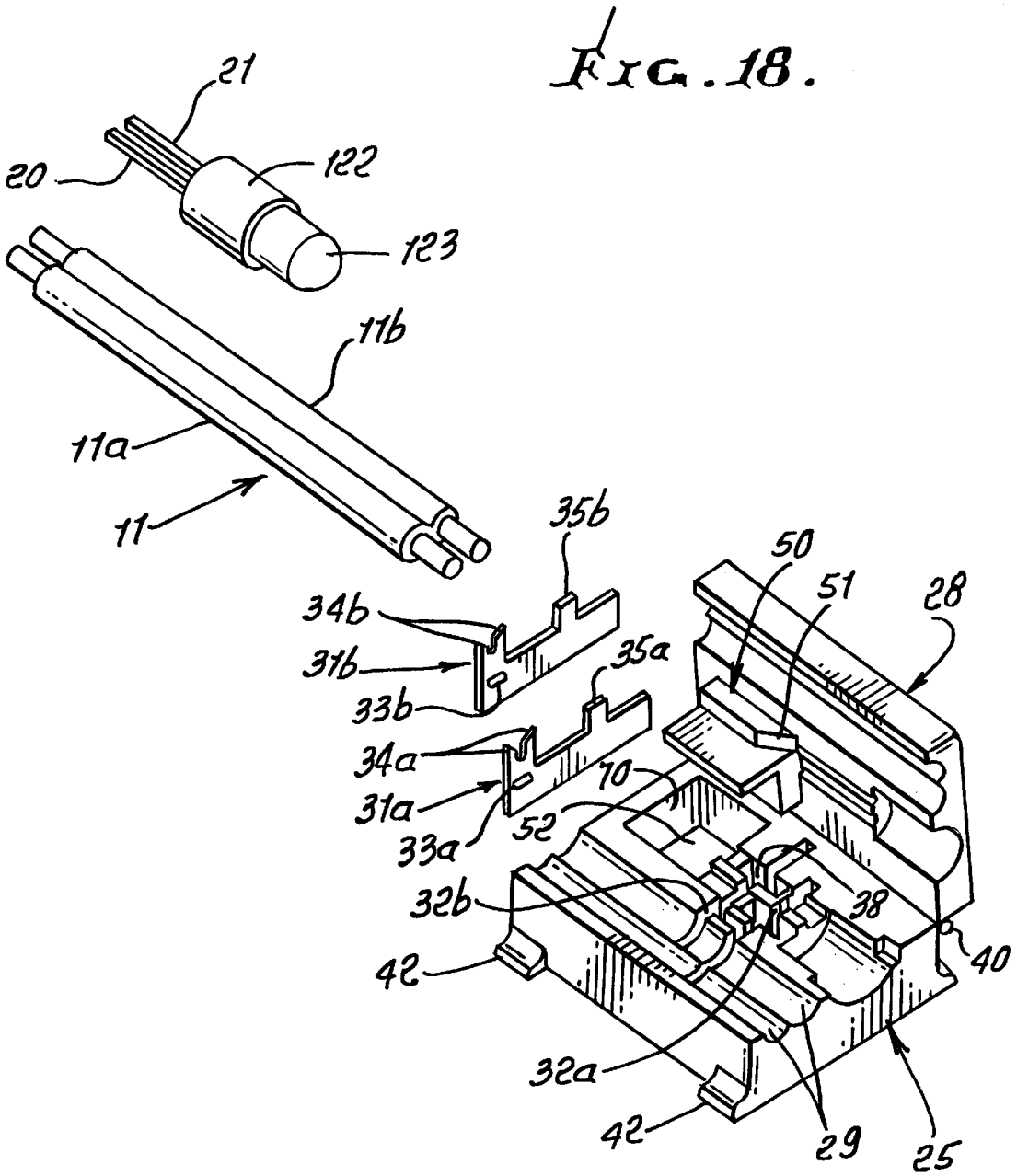
FIG. 18 is an exploded perspective view of the FIG. 10 apparatus in open condition, and also showing wiring and lead components.

The terminal structure includes blade means to penetrate sheathing defined by said electrical wiring, in response to relative movement of said clamping elements toward one another. As shown in FIG. 9, upwardly projecting V-shaped blades 34*a* on plate 31*a* are adapted, upon clamp-up, to cut into the sheathing of one wire, indicated at 11*a*, and to engage the wire core; and upwardly projecting V-shaped blades 34*b* on the other plate 31*b* are adapted, in response to clamp-up, to cut into the sheathing of the other wire, indicated at 11*b*, and to engage that wire core, thereby establishing electrical contacts between the two terminal plates and the respective wires.

Figure 6:
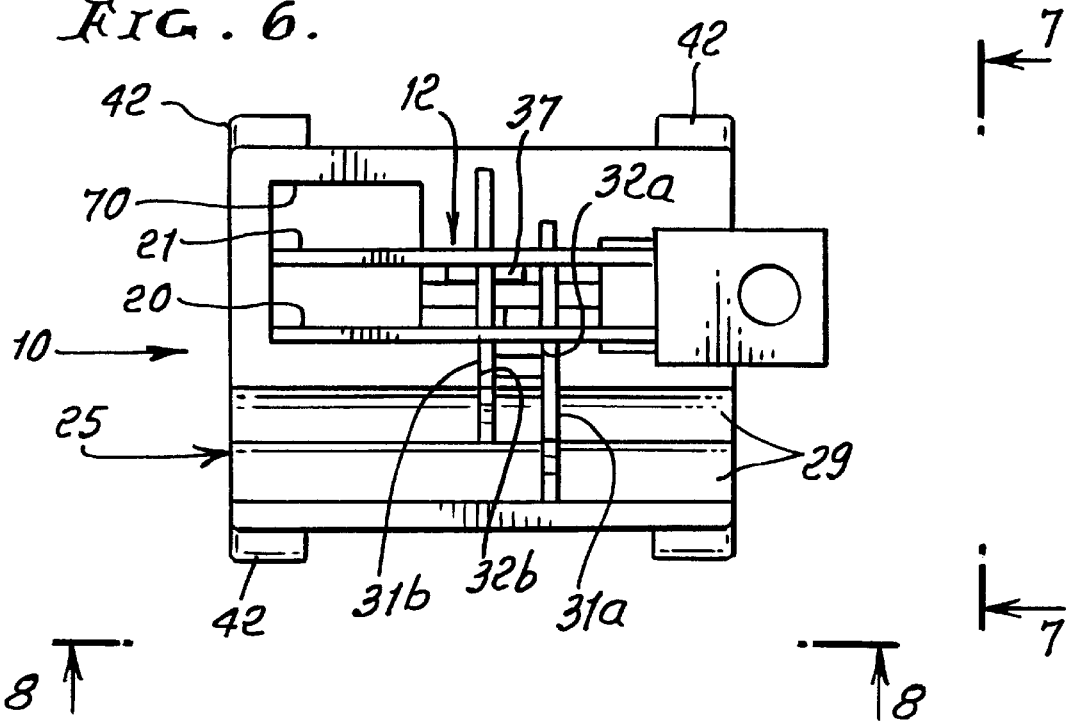
FIG. 6 is a top plan view of the FIG. 5 element.
Figure 7:
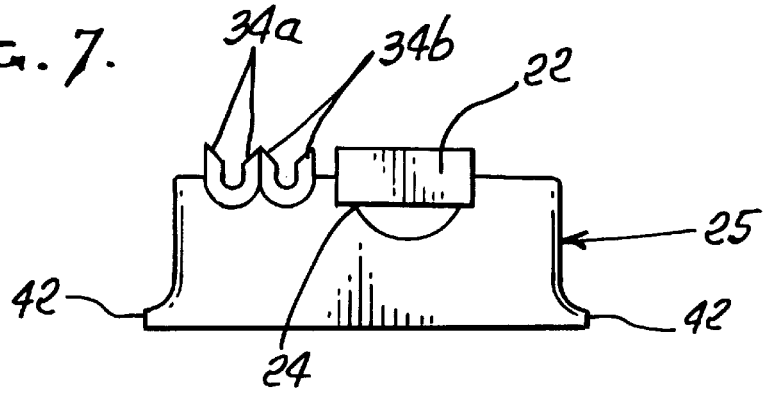
FIG. 7 is an end elevation view of the FIG. 6 element.
Figure 8:
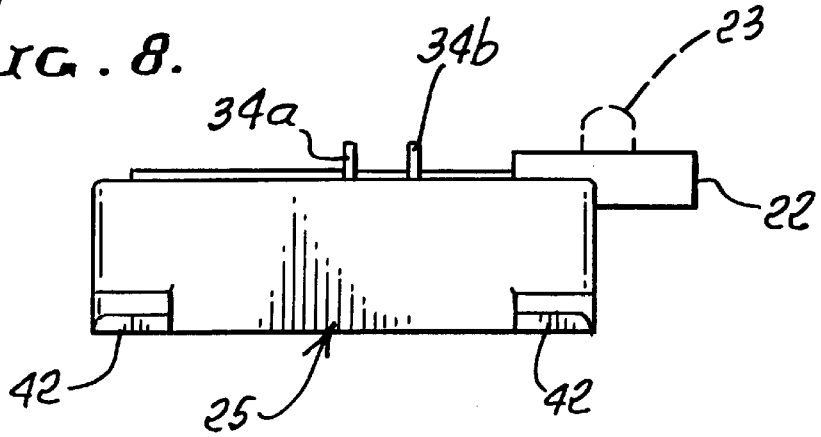
FIG. 8 is a side elevation view of the FIG. 6 element.

In addition, plate 31*a* has an upwardly projecting shoulder or edge 35*a* onto which lead 20 is downwardly engaged upon clamp-up, thereby establishing electrical contact between wire 11*a* and lead 20. Plate 31*b* has a similar shoulder or edge 35*b* to establish electrical contact between wire 11*b* and lead 21; however, an electrical impedance element is interposed in electrical series between edge 35*b* and lead 21, to be clamped therebetween. The impedance element may comprise a resistor 37, as shown in FIGS. 6 and 9. A slot 38 is formed on lower clamping element 25 to fittingly receive the resistor block, as is clear from FIG. 9.

The two clamping elements 25 and 28 may be interconnected as by a longitudinally extending hinge 40, as shown in FIG. 9, facilitating pivoted or hinged clamp-up. Lower element 25, in the form of a block, has feet 42 projecting for suitable attachment to a floor, wall, or other support surface. A latch means may be provided at 43 on front walls 44 and 45 of 25 and 28 to retain them in closed, clamping condition.

Referring to FIG. 9, a separator 50 integral with the upper clamping element 28 is swingable downwardly into recess 70 to project between the leads 20 and 21. A ramp 51 is also swingable downwardly to bend one of the leads, as for example lead 20, about 90° downwardly, for retention against inner wall 52 of 25. This serves to retain or lock the LED unit and its terminals in position.

FIG. 10–18 correspond to FIGS. 1–8, and have the same identifying numerals, excepting as to the modified holder indicated at 122. It is shown as cylindrical, and carries an incandescent type bulb 123. It fits in semi-cylindrical recesses 150 and 151 in 25 and 28, as shown. No resistor is employed, and tab shoulders or edges 34*a* and 34*b* are at the same level to engage 20 and 21.

Figure 19:
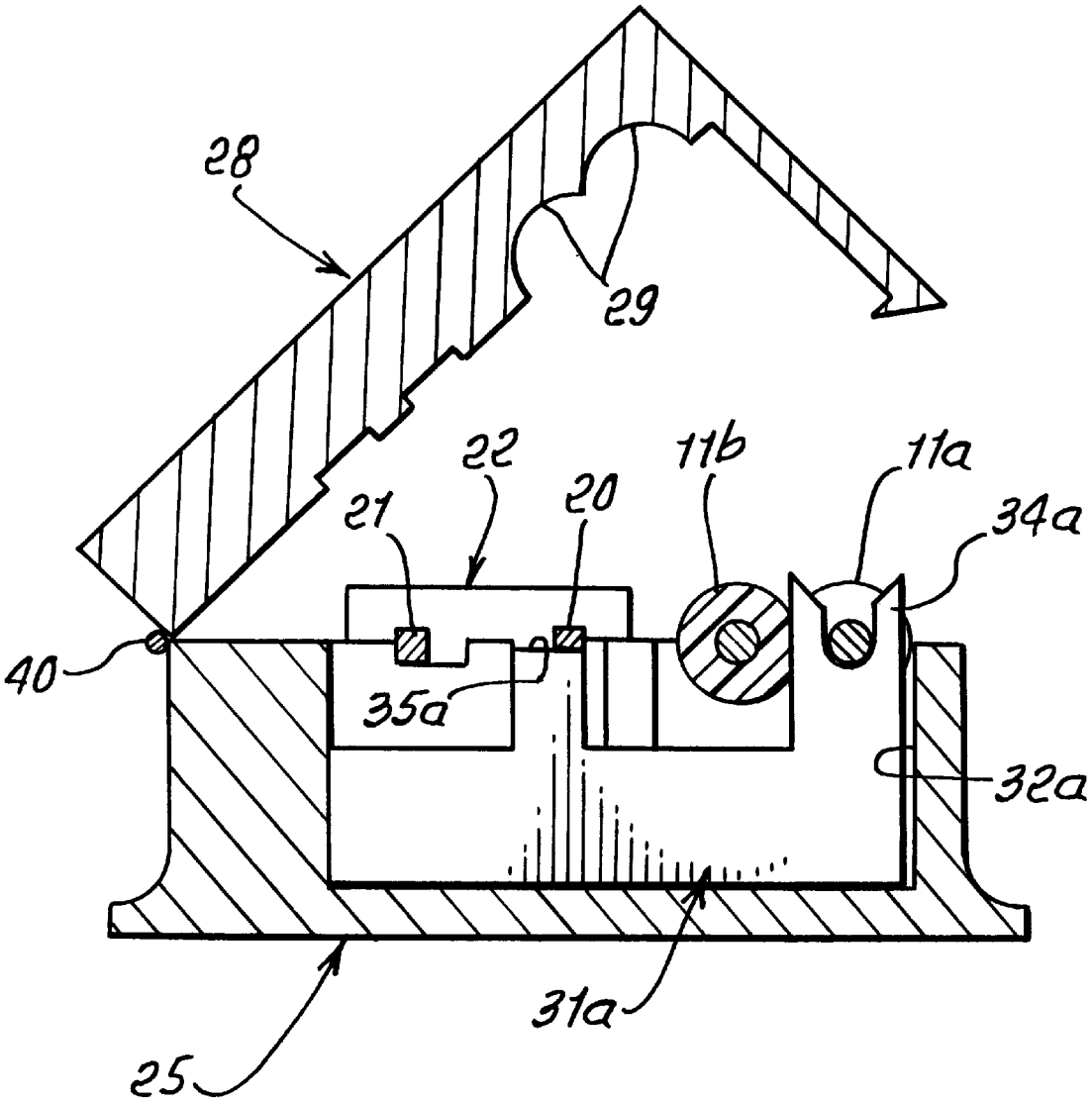
FIG. 19 is a schematic sectional view.
Figure 20:
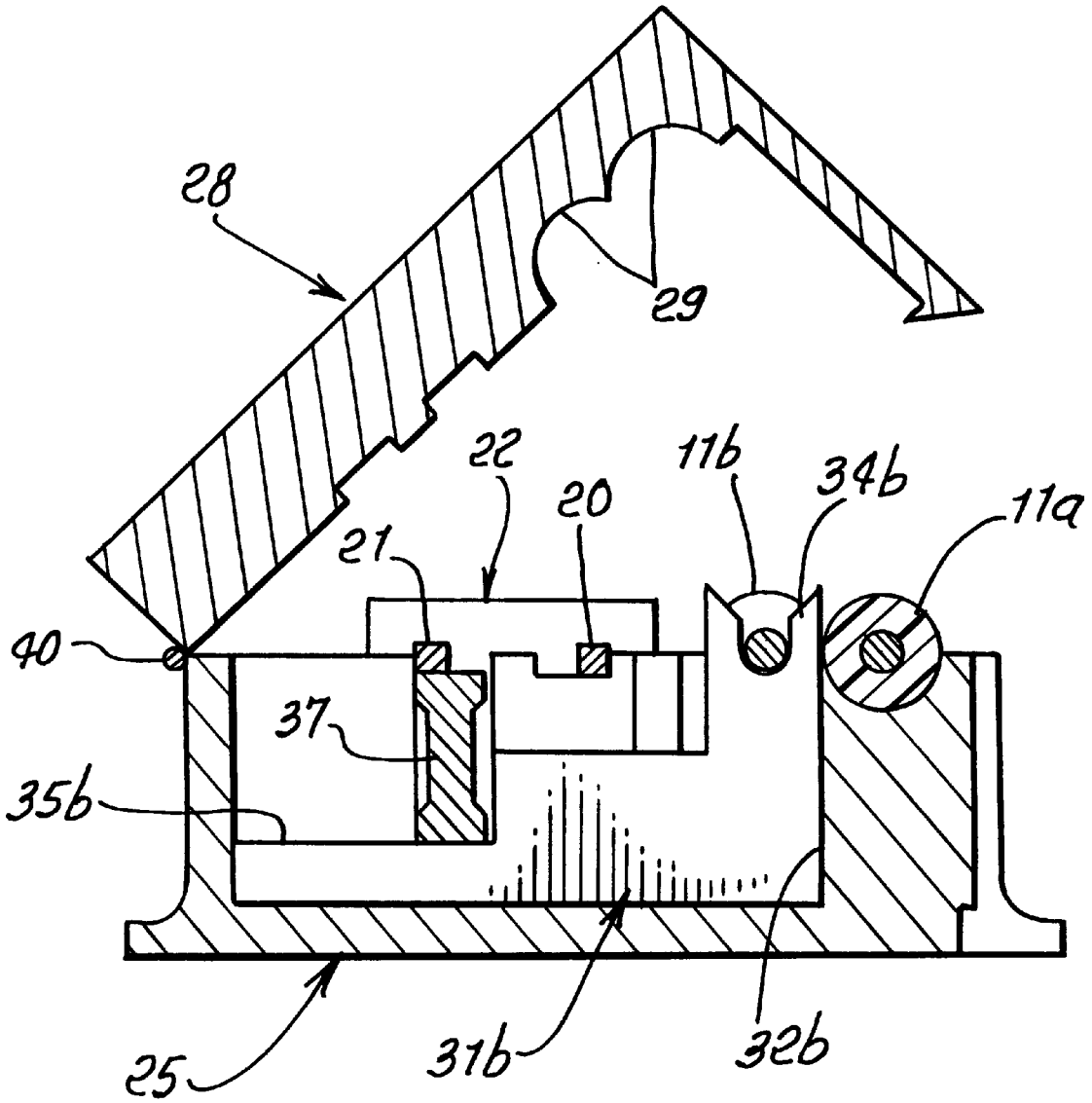
FIG. 20 is another schematic sectional view.

FIG. 19 is a schematic view showing elements of FIGS. 1–8 in enlarged configuration, with the side of terminal plate 31*a* and associated structure being shown. FIG. 20 is like FIG. 19, except that the side of the other terminal plate 31*b* is illustrated, along with associated structure.

I claim:

1. In apparatus for clamp-up electrical connection of electrical wiring and electrical lead structure, the combination comprising a) first and second relatively movable clamping elements and defining therebetween a first zone to receive the electrical wiring and a second zone to receive the electrical lead structure, and including said lead structure.

b) electrical terminal structure extending between said zones, c) said clamping elements relatively movable toward one another to effect clamping of said wiring relatively toward said terminal structure at said first zone, and clamping of said lead structure relatively toward said terminal structure, d) said terminal structure having a shoulder and there being an electrical impedance element clamped between said shoulder and said lead structure in electrical connection therewith and positioned in response to relative movement of said clamping elements toward one another.

2. The combination of claim 1 wherein said electrical terminal structure extends crosswise of said first and second zones, which are spaced apart.

3. The combination of claim 1 wherein said electrical terminal structure extends generally normal to said first and second zones which are spaced apart.

4. The combination of claim 2 wherein said terminal structure includes blade means to penetrate sheathing defined by said electrical wiring, in response to relative movement of said clamping elements toward one another.

5. The combination of claim 1 wherein said impedance element comprises an electrical resistor.

6. The combination of claim 1 wherein said terminal structure includes a plate carried by one of said clamping elements, and said shoulder defines an edge on the plate facing the other clamping element, and said impedance element engages said edge.

7. The combination of claim 1 wherein said terminal structure includes two plates carried by one of the clamping elements, said plates having edges facing the other clamping element, said impedance element engaging the edge of one plate, the edge of the other plate located to be engaged by a lead defined by said electrical lead structure, in response to movement of one clamping element relatively toward the other clamping element.

8. The combination of claim 1 wherein said electrical lead structure is positioned at said second zone.

9. The combination of claim 8 including said wiring positioned at said first zone.

10. The combination of claim 1 including hinge means interconnecting said clamping elements.

11. The combination of claim 1 including latch means carried by at least one of said clamping elements and operable to releasably interconnect said clamping elements.

12. The combination of claim 3 wherein the clamping elements have hinge interconnection to define a hinge axis, and including said wiring in said first zone extending substantially parallel to the hinge axis, and wherein the lead structure in said second zone extends substantially parallel to the hinge axis.

13. The invention of claim 12 wherein the electrical terminal structure extends generally normal to said wiring, lead structure and hinge axis.

14. The combination of claim 8 including a light source holder carrying said lead structure, and clamped by said clamping elements.

15. The combination of claim 14 including the light source carried by said holder, said source comprising one of the following:

i) an LED ii) an incandescent light bulb iii) an electrically energized light.

16. In apparatus for clamp-up electrical connection of electrical wiring and electrical lead structure, and including said wiring and lead structure, the combination comprising a) first and second relatively movable clamping elements and defining therebetween a first zone receiving the electrical wiring and a second zone receiving the electrical lead structure, b) electrical terminal structure, and c) said clamping elements relatively movable toward one another to effect clamping of said wiring, and said lead structure, with said electrical terminal structure in electrical communication between said wiring and said lead structure, d) there being an electrical resistor held clamped between said terminal structure and said lead structure by said clamping elements.

17. The combination of claim 16 wherein said terminal structure extends in at least one plane that is generally normal to said lead structure and said wiring.

18. The combination of claim 16 wherein said wiring extends in generally parallel and offset relation to said lead structure.

19. The combination of claim 16 including a light source in electrical series with said lead structure.

20. The combination of claim 19 wherein said light source comprises one of the following:

i) an LED ii) an incandescent light bulb iii) an electrically energized light.

21. The combination of claim 19 wherein said clamping elements when closed relatively together form a box configured structure, said light source protruding from said structure.

22. The combination of claim 21 wherein said light source is clamped by said elements when closed relatively together.

23. The combination of claim 22, wherein said elements define recesses into which said light source is received when said elements are closed relatively together.

24. The combination of claim 21 wherein said wiring also protrudes from said structure, in offset relation to said protruding light source.

25. The combination of claim 17 wherein said terminal structure includes blade means to penetrate sheathing defined by said electrical wiring, in response to relative movement of said clamping elements toward one another.

26. The combination of claim 16 wherein said terminal structure includes two plates having cutting edges for penetrating sheathing carried by said wiring in response to relative closing together of said elements and force transmission to said plates.

* * * * *